United States Patent [19]

Yamaguchi et al.

[11] Patent Number: 4,659,891

[45] Date of Patent: Apr. 21, 1987

[54] MICROWAVE OVEN HAVING AN ELECTROMAGNETIC ENERGY SEAL

[75] Inventors: Kimiaki Yamaguchi, Ikoma; Masahiro Nitta, Nara; Kazuyuki Inoue, Yamatokoriyama; Teruo Hirose, Hirakata; Yoshihiro Toda, Kyoto, all of Japan

[73] Assignee: Matsushita Electric Industrial Co., Ltd., Osaka, Japan

[21] Appl. No.: 844,000

[22] Filed: Mar. 25, 1986

[30] Foreign Application Priority Data

Mar. 27, 1985 [JP] Japan ..... 60-62513

[51] Int. Cl.[4] ..... H05B 6/76

[52] U.S. Cl. ..... 219/10.55 D; 174/35 MS

[58] Field of Search ..... 219/10.55 D, 10.55 R; 174/35 MS, 35 GC, 35 R

[56] References Cited

U.S. PATENT DOCUMENTS 4,475,023 10/1984 Iwabuchi et al. ..... 219/10.55 D 4,523,069 6/1985 Staats ..... 219/10.55 D 4,525,614 6/1985 Ishino et al. ..... 219/10.55 D 4,584,447 4/1986 Kusonoki et al. ..... 219/10.55 D

*Primary Examiner*—Philip H. Leung

*Attorney, Agent, or Firm*—Spencer & Frank

[57] ABSTRACT

An electromagnetic energy seal for use in a microwave oven comprises a first sealing cavity formed along at least one of a peripheral edge portion of an entrance opening of a heating chamber and a portion of a door for opening and closing the entrance opening of the heating chamber which is opposite to the peripheral edge portion of the entrance opening of the heating chamber, and a second sealing cavity disposed in the opening of the first sealing cavity. These first and second sealing cavities have a simple structure which produces high shield effects against the fundamental microwave frequency and the higher harmonic microwave frequency components thereof, respectively, and the adjustment and optimization of the choking frequency characteristics of the cavities can be made easy.

6 Claims, 16 Drawing Figures

MICROWAVE OVEN HAVING AN ELECTROMAGNETIC ENERGY SEAL

BACKGROUND OF THE INVENTION

1. Field of the Invention

This invention relates to an electromagnetic energy seal for preventing leakage of electromagnetic waves through a gap between a door and a heating chamber formed in the body of a microwave oven or the like, and more particularly to a choke cavity arrangement having an electromagnetic energy sealing function both for the fundamental frequency electromagnetic wave used for heating and the higher harmonic electromagnetic waves.

2. Description of the Related Art

A magnetron is now most commonly used as an oscillator tube in an apparatus such as a microwave oven, because it operates at a high oscillation efficiency and has a simple structure. However, the magnetron generates, in addition to the microwave frequency of 2,450 MHz which is the fundamental frequency of the microwave energy used for heating, higher harmonic microwaves having frequencies n times (n=positive integers) as high as the fundamental frequency.

Various communication techniques have recently been developed, and the utilization of microwave frequency bands in the communication field has been developed. Especially, in the past several years, the use of a frequency range in the vicinity of 12.25 GHz, which is the fifth higher harmonic of 2,450 MHz, in the DBS (a direct broadcasting system) has been promoted. Because of such a trend, the suppression of the leakage of higher harmonic microwave components from a microwave oven or the like has been demanded to an extent greater than before, and, especially, the possibility of impartation of actual harm to the DBS by the fifth harmonic microwave component is now drawing the attention of those who have a concern in this communication field.

A door of a microwave oven is provided with a choke cavity at an outer peripheral part of the door which is opposite to the peripheral edge of the entrance opening of the heating chamber when the door is closed, so that an electromagnetic wave may not leak to the outside through a gap between the heating chamber and the door in the closed position of the door. However, although this choke cavity exhibits a great choking effect mainly against the fundamental frequency wave of 2,450 MHz, it exhibits almost no choking effect against the aforementioned higher harmonic microwave components, especially, the fourth or fifth higher harmonic component. Therefore, the provision of a second and a third choke cavity has been proposed for the purpose of preventing the leakage of such higher harmonic microwave components. (The arrangement of such choke cavities are disclosed in, for example, Japanese Examined Utility Model Publication No. 48-4121, Japanese Examined Utility Model Publication No. 48-5070, Japanese Examined Utility Model Publication No. 52-7880 and Japanese Examined Patent Publication No. 52-3126.)

However, a microwave oven provided with such prior art choke cavities, in which individual choke cavities are disposed independently of one another, becomes complicated in structure and large in size, and has not been satisfactorily suitable for practical use from the view points of manufacturing cost and design.

SUMMARY OF THE INVENTION

It is a primary object of the present invention to provide an electromagnetic energy seal of a very simple and compact structure which still has excellent leakage preventing capability, in which a choke cavity for preventing the leakage of higher harmonic microwave components is disposed inside a main choke cavity for preventing the leakage of the fundamental microwave frequency component of 2,450 MHz.

DESCRIPTION OF THE PREFERRED EMBODIMENTS

Figure 1:
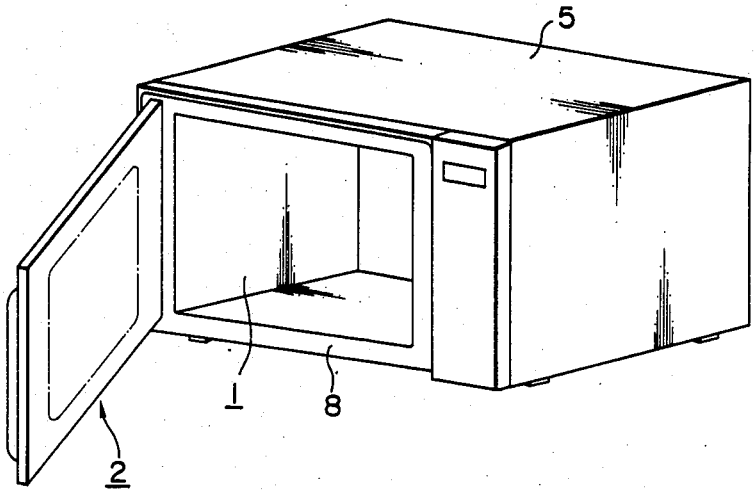
FIG. 1 is a general perspective view of a microwave oven provided with the electromagnetic energy seal of an embodiment of the present invention.

FIG. 1 is a general perspective view of a microwave oven provided with an electromagnetic energy seal of a preferred embodiment of the present invention. Referring to FIG. 1, a heating chamber 1 is enclosed in an oven body 5, and the entrance opening of the heating chamber 1 is opened or closed by a door 2.

Figure 2:
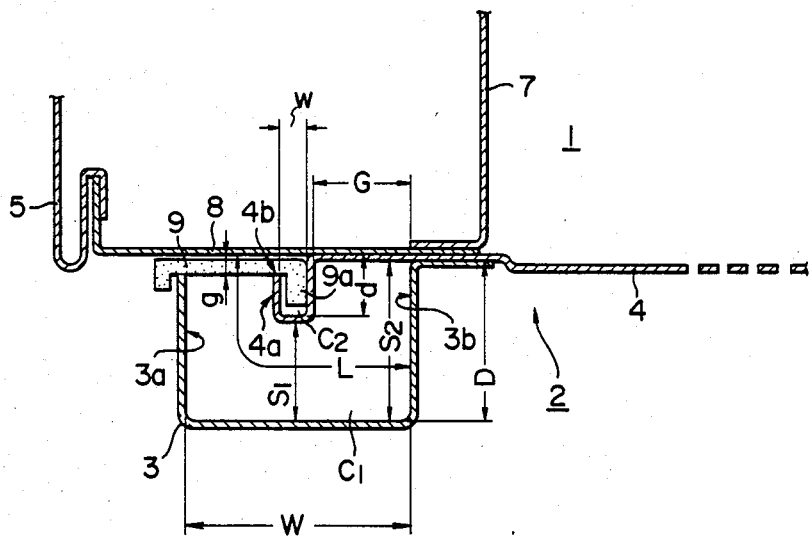
FIG. 2 is a sectional view of an essential part of the electromagnetic energy seal for use in a microwave oven of an embodiment of the present invention.
Figure 3:
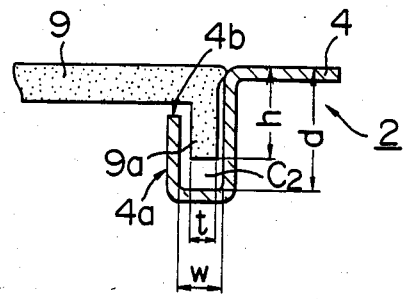
FIG. 3 is an enlarged sectional view of a part of the electromagnetic energy seal shown in FIG. 2.
Figure 4:
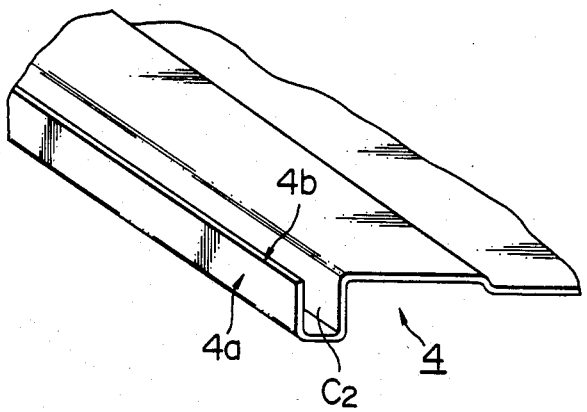
FIG. 4 is a perspective view of an essential part of the seal plate shown in FIG. 2.

FIGS. 2, 3, and 4 are sectional views respectively showing essential parts of the microwave oven shown in FIG. 1. Members constituting the door 2 include a seal plate 4 and an outer frame member 3. The seal plate 4 engages with the peripheral edge 8 of the entrance opening of the heating chamber 1 when the door 2 is closed. The outer frame member 3 is fixed by spot welding, etc. to an outer peripheral portion of the seal plate 4 and has a generally U-shaped section. The outer frame member 3 has an opening opposite to the peripheral edge 8 of the entrance opening of the heating chamber 1. The outer frame member 3 defines a first sealing cavity C1 which acts as a choke cavity for preventing the leakage of the fundamental frequency microwave. The outer peripheral edge of the seal plate 4 is formed to have a generally U-like sectional shape, thereby defining a second sealing cavity C2. The opening of the second sealing cavity C2 is opposed to the peripheral edge 8 of the entrance opening of the heating chamber 1, and both the depth d and the width w of the second sealing cavity C2 are smaller than one half the depth D and the width W of the first sealing cavity C1, respectively. More precisely, the inner inside wall of the second sealing cavity C2 is spaced apart by a distance G from the inner inside wall 3*b* of the outer frame member 3 forming the first sealing cavity C1. Therefore, the transmission path having an electrical length L and ranging from the opening of the first sealing cavity C1 to the inner inside wall 3*b* of the first sealing cavity C1, which functions as a short-circuiting plane, is formed such that the transmission path is narrowed once to have a height S1 by the projection formed by the outer wall of the second sealing cavity C2 when viewed from the side of the opening, and then it becomes wider to have a height S2, and then it terminates at the inner inside wall 3*b* of the first sealing cavity C1.

Further, as shown in FIG. 2, the sealing cavities C1 and C2 are covered at the opening ends thereof by a common cavity cover 9 made of a dielectric material such as a resin, and the cavity cover 9 has a flange-shaped projection 9*a* extending into the second sealing cavity C2.

In the electromagnetic energy seal having the structure described above, the second sealing cavity C2 acts as a choke for mainly preventing the leakage of the electromagnetic waves of the higher harmonic frequencies, and the first sealing cavity C1 acts as a choke for mainly preventing the leakage of the electromagnetic wave of the fundamental frequency. It will be seen that the second sealing cavity C2 is positioned within the opening of the first sealing cavity C1. Thus, not only the second sealing cavity C2 functions merely as a higher-harmonic choke, but also it has the function of improving the sealing effect of the first sealing cavity C1, and, at the same time, reducing the dimension of the first sealing cavity C1. These two effects will now be described in more detail.

In the prior art seal arrangement which is not provided with the higher-harmonic sealing cavity, various higher-order mode electromagnetic waves have appeared at the opening of the first sealing cavity, especially, at the peripheral edge of the seal plate 4, and the propagation mode of the electromagnetic waves has not been constant, resulting in an unstable choking effect. In contrast, in the case of the structure of the embodiment of the present invention as described above, the outer inside wall 3*a* of the first sealing cavity C1 and the outer outside wall 4*a* of the second sealing cavity C2 define a parallel transmission path extending from the opening of the first sealing cavity C1 toward the inside of the cavity C1, so that the appearance of the higher-order mode electromagnetic waves can be suppressed, thereby improving and stabilizing the choking effect.

Figure 5:
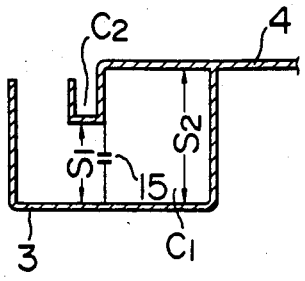
FIG. 5 is an explanatory drawing illustrating the principle of the present invention, in which FIG. 5(*a*) is a schematic sectional view of the electromagnetic energy seal of the present invention, FIG. 5(*b*) is a schematic sectional view of a ridge waveguide, and FIG. 5(*c*) shows an equivalent circuit of the ridge waveguide shown in FIG. 5(*b*).
Figure 5:
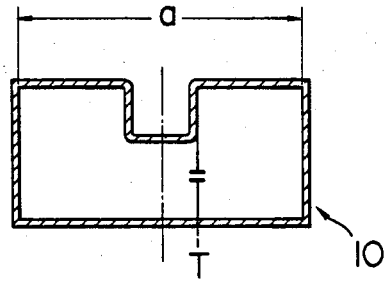
Figure 5:
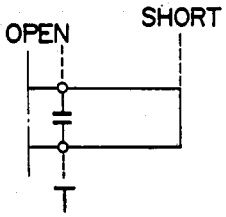

The effect of reducing the dimensions of the first sealing cavity C1 will be described with reference to FIG. 5. FIG. 5(*a*) is a schematic sectional view of the electromagnetic energy seal of the embodiment shown in FIG. 2. As described already, the transmission path formed by the first sealing cavity C1 is narrowed to have the height S1 by the projection provided by the outside wall of the second sealing cavity C2, and, therefore, capacitive impedance 15 is produced at this portion. The electrical length L of the transmission path formed within the first sealing cavity C1 is determined by factors including this capacitive impedance 15. Therefore, the electrical length L is increased as compared with the arrangement in which the second sealing cavity C2 is not present. This effect can also be analytically verified. However, a ridge waveguide 10 as shown in FIG. 5(*b*) will now be compared with a waveguide of a straight rectangular cross-section having the same width a. The ridge waveguide 10 can operate with a cut-off frequency much lower than that of the straight rectangular waveguide by virtue of the effect of the presence of the ridge on the propagation mode of the electromagnetic waves in the transverse direction as shown in FIG. 5(*b*). The effect obtained by the embodiment of the present invention will be understood from the facts given above with reference to the ridge waveguide 10. FIG. 5(*c*) is an equivalent circuit corresponding to the ridge waveguide 10 shown in FIG. 5(*b*). This equivalent circuit is considered to be equivalent to that of the first sealing cavity C1 shown in FIG. 5(*a*). This means that the provision of the second sealing cavity C2 along the outer peripheral edge of the seal plate 4 makes it possible to realize the same electrical length L with a smaller value of the width W. Therefore, the provision of the second sealing cavity C2 serving for the higher-harmonic microwaves choking purpose results in a reduction in the dimension of the first sealing cavity C1 serving for the fundamental frequency microwave choking purpose.

It will be seen from the above description that, with a structure substantially the same as that of the choke cavity having the function of choking the fundamental microwave frequency of 2,450 MHz, it becomes possible not only to obtain the door 2 provided with the second sealing cavity C2 serving for the higher-harmonic microwaves choking purpose, but also to attain both a reduction in the dimension of the first sealing cavity Cl and an improvement in the choking performance.

The outermost end 4*b* of the peripheral edge of the seal plate 4 is at the top of the outer outside wall 4*a* of the second sealing cavity C2. The position of this top is spaced apart by one fourth the wavelength of the fundamental microwave frequency in terms of the electrical length from the inner inside wall 3*b* of the first sealing cavity C1 operating as a short-circuiting point. Therefore, at this point, the value of the current of the fundamental frequency becomes zero, and the corresponding electric field intensity becomes maximum. Thus, the possibility that a spark discharge will be generated between this point and the peripheral edge 8 of the entrance opening of the heating chamber 1 becomes high. However, the danger of causing this discharge is minimized by the arrangement in which a gap g is provided between the end 4*b* of the wall 4*a* and the peripheral edge 8 of the entrance opening of the heating chamber 1, and the cavity cover 9 made of a resin covers the end 4*b* of the wall 4*a*. Further, the second sealing cavity C2 is formed by simple working, namely, by merely partly bending the outer peripheral edge of the seal plate 4. Therefore, the number of parts does not increase, the structure is simple, and the manufacturing cost is almost the same as when the second sealing cavity C2 serving for the higher-harmonic microwaves choking purpose is not provided. Furthermore, the second sealing cavity C2 acts also as a reinforcing rib for the entire door 2.

Further, the flange-shaped projection 9*a* of the cavity cover 9 extending into the second sealing cavity C2, as shown in FIGS. 2 and 3, acts as a reinforcing rib for increasing the mechanical strength of the cavity cover 9, thereby preventing undesirable floating and detachment of the cavity cover 9. Further, it is possible to prevent an adverse effect on the function of the cavity cover 9 which could be caused by mere slight floating of the cavity cover 9. As is commonly known, the electrical length (measured by the wavelength) which determines such a choking function is dependent upon the relative dielectric constant $\epsilon_\nu$ of a propagation medium. Thus, it is a more important fact that, by the presence of the flange-shaped projection 9*a*, there occurs a variation in the frequency at which the second sealing cavity C2, namely, the higher-harmonic microwaves choking cavity exhibits its choking effect. Suppose that the dielectric material forming the cavity cover 9 is a resin whose relative dielectric constant $\epsilon_\nu$ is equal to 2.2, and the flange-shaped projection 9*a* of the cavity cover 9 is completely inserted into the second sealing cavity C2. Then, the frequencies of the electromagnetic waves, at which the second sealing cavity C2 exhibits its choking effect, is changed to be multiplied by $1/\sqrt{\epsilon_\nu} \approx 1/1.5$, that is, about $\frac{2}{3}$. Therefore, when the thickness t and height h of the flange-shaped projection 9*a* are changed depending on the width w and the depth d of the second sealing cavity C2, the frequencies at which the second sealing cavity C2 exhibits its choking effect can be changed up to their maximum values attained by the multiplication by $1/\sqrt{\epsilon_\nu}$. Here, the insertion of the flange-shaped projection 9*a* into the second sealing cavity C2 only affects the choking effect of the second sealing cavity C2, but it does not substantially affect the choking effect of the first sealing cavity C1. Therefore, the choking effect on the higher harmonics can be adjusted independently of the choking function for the fundamental frequency microwave of 2,450 MHz. Among the higher harmonic microwaves radiated into the heating chamber of a microwave oven, the higher harmonic microwaves raising a problem generally cover a wide frequency range from the second to the seventh higher harmonic. The specific higher harmonic requiring the highest shield effect differs depending on the regulations of each country where the microwave oven is used and also on the characteristics of the magnetron used as the oscillating tube thereof. Also, even with the same orders of higher harmonics, the spectrum of the higher harmonic microwaves varies delicately depending on the type of magnetron used and also on the design of the heating chamber.

In this respect, the structure of the seal of the present invention is very effective in that, by merely modifying the dimension of the flange-shaped projection 9*a* of the cavity cover 9, the adjustment for the optimum frequency can be attained only by the dimensional adjustment of the cavity cover 9 still independently of the characteristics of the fundamental microwave frequency, so that not only the common use of the parts of microwave ovens becomes easy, but also the design of microwave ovens can be simplified.

Figure 6:
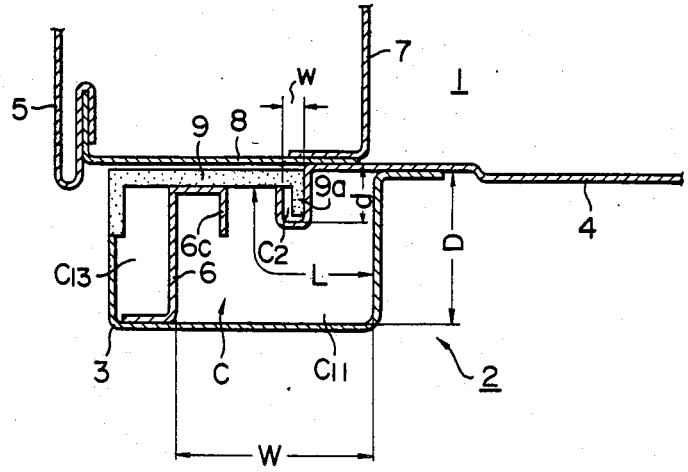
FIG. 6 is a sectional view of an essential part of the electromagnetic energy seal for use in a microwave oven of another embodiment of the present invention.
Figure 7:
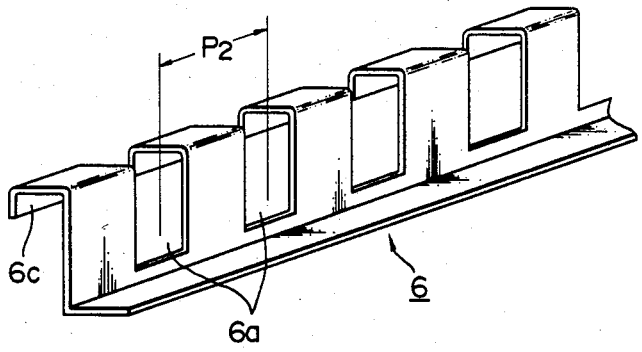
FIG. 7 is a perspective view of an essential part of the partition member shown in FIG. 6.

FIG. 6 shows the electromagnetic energy seal of another embodiment of the present invention. This embodiment is a modification of that shown in FIG. 2 and differs only from the latter in the structure of the first sealing cavity C1 in FIG. 2 constituted by the seal plate 4 and the outer frame member 3. More precisely, the sealing cavity C in this embodiment is similarly constituted by the outer peripheral portion of the seal plate 4 and the outer frame member 3, which is fixed to the seal plate 4 by spot welding, etc. and which has a generally U-shaped section, with the opening side of the outer frame member 3 being opposite to the peripheral edge 8 of the entrance opening of the heating chamber 1. However, in this sealing cavity C, there is further provided a partition member 6 made of a metal material partitioning the sealing cavity C into a first sealing cavity C11 and a third sealing cavity C13. This partition member 6 is slitted at regular spatial intervals. In this embodiment, both the first sealing cavity C11 and the third sealing cavity C13 provided by partitioning the cavity C into the two parts function as choke cavities, the central choke frequency thereof being equal to the fundamental wave frequency. Therefore, the fundamental structure and functional effect thereof do not basically differ from those of the first sealing cavity C1 of the embodiment shown in FIG. 2. FIG. 7 is an enlarged perspective view of the partition member 6. FIG. 7 shows that the slitted structure is formed by providing slits 6*a* in the partition member 6 at a pitch P2. Thus, by merely optimizing the dimension of the pitch P2, for example, the choke effect against the fundamental microwave frequency can be improved. The structure and functional effect of this embodiment are the same as those of the first embodiment described already with reference to FIG. 2.

The dimension of each of the cavities C11, C2 and C13 is selected to be optimum for the frequency to be choked thereby. Each of such cavities has a choking characteristic covering a very broad frequency range. This tendency is above all the case with the cavity C2 for choking higher harmonic microwave components. Generally, a large shielding effect can be obtained by a choke cavity in the vicinity of a frequency at which the length along the electromagnetic wave propagation path within the choke cavity becomes equal to $\frac{1}{4}\lambda$. This fact applies in common to both the fundamental microwave frequency and the higher harmonic microwaves frequencies.

Further, by reducing the width w of the second sealing cavity C2 to be smaller than about 1/30 of the wavelength $\lambda$ of the fundamental frequency microwave, it is possible to make the second sealing cavity C2 function merely as a metal wall rather than a choke cavity against the fundamental microwave frequency.

Exemplifying numerical values of the electromagnetic energy seal shown in FIG. 6 will now be described. In the embodiment shown in FIG. 6, the width W and depth D of the first cavity C11 are 27 mm and 21 mm, respectively; the width w and depth d of the second cavity C2 are 2.5 and 8 mm, respectively; and the thickness t and height h of the flange-shaped projection 9*a* are about 1.5 and 5 mm, respectively. With the above-selected dimensional values, the first sealing cavity C11 can exhibit a high shield effect in the vicinity of the fundamental frequency of 2,450 MHz, and the second sealing cavity C2 can exhibit a large shield effect in the vicinity of the fourth and fifth higher harmonics.

Figure 8:
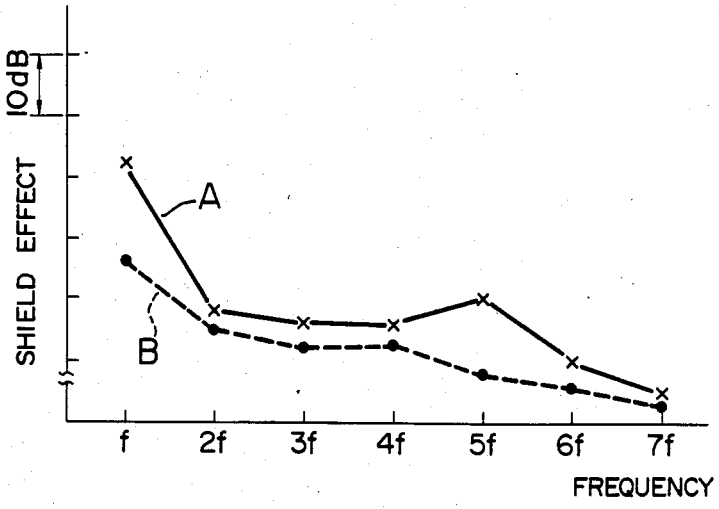
FIG. 8 is a graph showing the result of a comparison test for comparing the shield effect of the electromagnetic energy seal of the present invention with that of a prior art seal.

FIG. 8 is a graph showing the results of a comparison test for comparing the shield effect of the electromagnetic energy seal of the present invention having the structure described above with that of a prior art seal which is not provided with a higher-harmonic choking cavity. In FIG. 8, the solid curve A represents the shield effect of the seal of the present invention, and the broken curve B represents that of the prior art seal. It will be seen from FIG. 8 that the present invention is effective in improving the shield effect. Namely, the improvement in the electromagnetic energy leakage preventing effect can be seen in the frequency ranges around the fifth higher harmonic (5f=12.25 GHz) and around the fundamental frequency (f=2.45 GHz).

Figure 9:
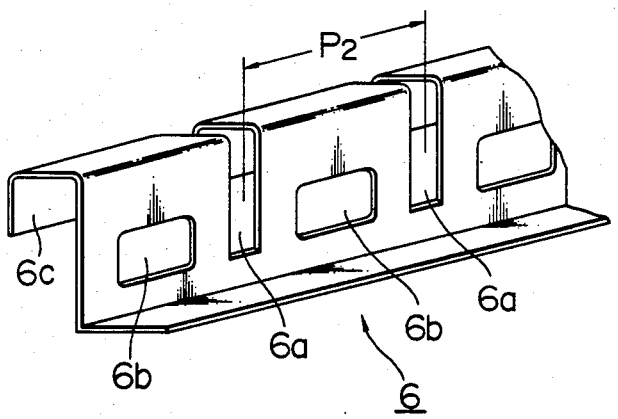
FIG. 9 is a perspective view of an essential part of the partition member of another form for use in the electromagnetic energy seal of the present invention.
Figure 10:
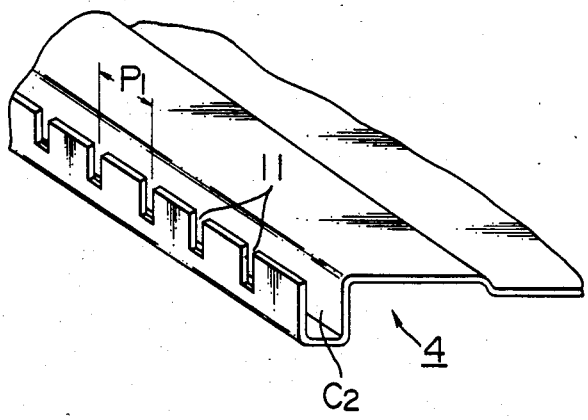
FIGS. 10, 11, 12 and 13 are perspective views respectively showing an essential part of the seal plate of the other forms for use in the electromagnetic energy seal of the present invention.

In the practical design of the embodiments of the present invention shown in FIGS. 2 and 6, various modifications and combinations may be made. For example, the partition member 6 shown in FIG. 6 may have a shape as shown in the perspective view of FIG. 9. In FIG. 9, the partition member 6 is designed to optimize the shape, dimension and position of the rectangular holes 6*b*, the bent portions 6*c* of the top wall, etc., and, as a result, it becomes possible to attain the minimization of the size of the fundamental frequency choking cavities.

FIGS. 10, 11, 12 and 13 show various modifications of the seal plate 4. First, in the modification of the seal plate 4 shown in FIG. 10, equally spaced slits 11 are provided in the wall of the second sealing cavity C2, and the pitch P1 of the slits 11 is determined depending on the frequency of a higher harmonic or harmonics to be choked by the second sealing cavity C2. Therefore, this pitch P1 is generally smaller than the pitch P2 of the slits 6*a* of the partition member 6 shown in FIG. 9. The slits 11 may be disposed at various portions of the partition member 6 including the bottom wall of the second sealing cavity C2. Anyway, the slits 11 are provided as required for the purpose of improving the frequency characteristic of the shield effect of and the shielding performance of the second sealing cavity C2.

Figure 11:
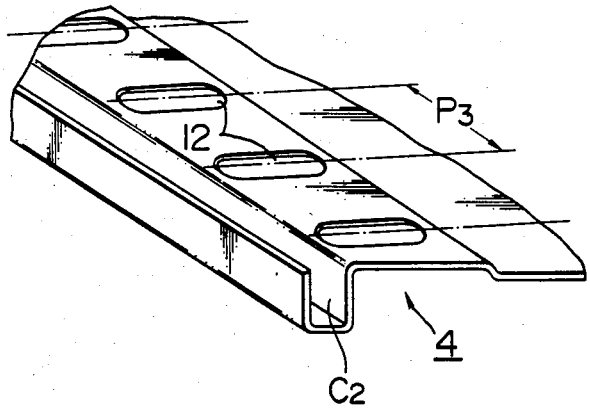
Figure 12:
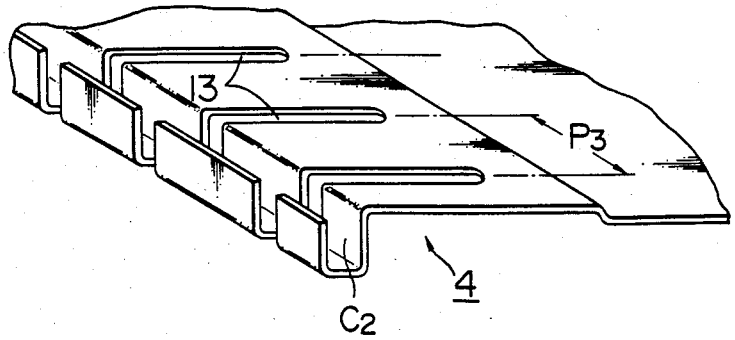
Figure 13:
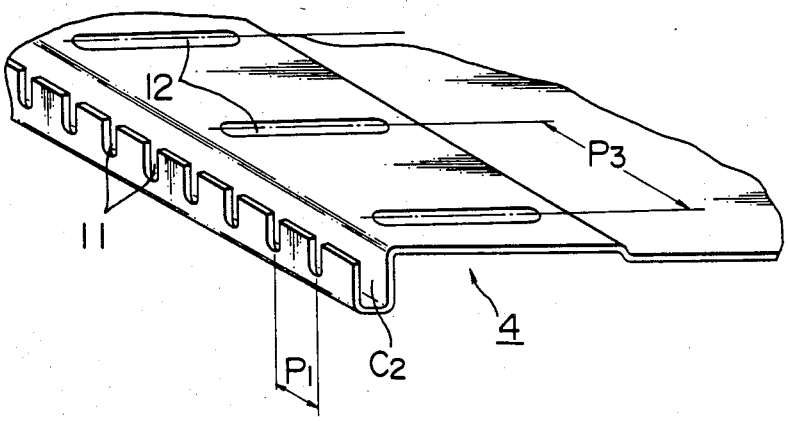

In another modification shown in FIG. 11, elongated holes 12 are formed in a peripheral edge portion of the seal plate 4 along which the electromagnetic wave is introduced into the second sealing cavity C2. The shield effect to be produced by the elongated holes 12 and the selection of the pitch P3 of the elongated holes 12 may be taken to be similar to those of the slits 6*a* of the partition member 6 shown in FIG. 9. In another modification shown in FIG. 12, slits 13 are formed extending from the electromagnetic wave introducing peripheral edge portion of the seal plate 4 to the bent wall of the second sealing cavity C2. The second sealing cavity C2 of the above-mentioned structure exhibits its shield effect against both the fundamental microwave frequency and the higher harmonic microwave frequency components. Still another modification shown in FIG. 13 is a combination of the modifications shown in FIGS. 10 and 11.

Figure 14:
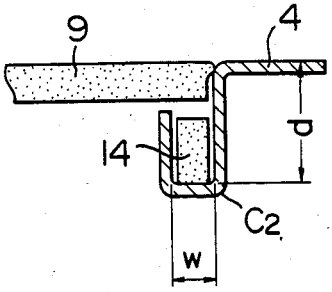
FIG. 14 is an enlarged sectional view of the second sealing cavity C2 of another structure for use in the electromagnetic energy seal of the present invention.

FIG. 14 shows a modification of the flange-shaped projection 9*a* of the cavity cover 9 extending into the second sealing cavity C2 shown in FIGS. 2 and 3. Referring to FIG. 14, a separate dielectric member 14 is provided apart from the body of the cavity cover 9, and it is fitted in the second sealing cavity C2. This dielectric member 14 may be made of a dielectric material having a dielectric constant different from that of the cavity cover 9. Further, when occasion demands, an electromagnetic wave energy absorbing material such as ferrite, etc. may be used to form the member 14 so that the member 14 may produce both of a choking effect and an electromagnetic wave energy absorbing effect. As a practical example of such a ferrite type material for forming the member 14 mentioned above, Ni-Mg-Zn type ferrite powder or Mn-Zn type ferrite is used. It is mixed with an electrically insulating material such as rubber, plastics or the like, and then the mixture is molded. The foregoing description has been made with resepct to the arrangement where the cavities are disposed on the side of the door of a microwave oven. However, it is apparent that entirely the same effect described above can be produced by a structure in which the cavities are disposed in the outer peripheral portion of the entrance opening of the heating chamber of the microwave oven.

It will be understood from the foregoing detailed description that the present invention provides an electromagnetic energy seal for a microwave oven in which a choke cavity for choking higher harmonic microwave components is disposed in the opening of a choke cavity for choking the fundamental microwave frequency of 2,450 MHz. Thus, it is possible to provide an electromagnetic energy seal which is compact and simple in structure as compared with a prior art seal having only a fundamental frequency microwave choking cavity and which produces a higher shield effect against both the fundamental microwave frequency and the higher harmonic microwave frequency components.

Especially, in the electromagnetic energy seal of the present invention, the peripheral end portion of the seal plate 4 is formed to have a generally U-shaped section thereby defining the higher-harmonic choke cavity, and the outer frame member 3 formed to have a generally U-shaped section and to enclose the higher-harmonic microwave components choking cavity is fixed by spot welding, etc. to the peripheral portion of the seal plate 4 thereby to define the fundamental frequency microwave choking cavity. Thus, with the structure of the seal proposed by the present invention, it is possible to provide an electromagnetic energy seal which is compact and inexpensive, since the constituent components of the seal of the present invention are substantially the same as those of the prior art seal including only the fundamental frequency microwave choking cavity.

Further, the electromagnetic energy seal of the present invention comprises the cavity cover 9 provided with the flange-shaped projection 9*a* extending from an inner peripheral edge of the cavity cover 9 into the higher-harmonic microwave components choking cavity. By virtue of the structure of the seal of this invention, it is possible to freely adjust and optimize the frequency characteristics of the higher-harmonic microwave components choking cavity without affecting the frequency characteristic of the fundamental frequency microwave choking cavity. Therefore, it is not only easy to design the higher-harmonic microwave components choking cavity, but also the higher-harmonic microwave components choking cavity can be brought into an optimum operating condition merely by suitably changing the form, dimension and/or constituent material of the cavity cover depending on the regulations of the country in which the microwave oven is used, the type of magnetron incorporated in the microwave oven, and the design of the heating chamber.

We claim:

1. A microwave oven having an electromagnetic energy seal, comprising a heating chamber having an entrance opening therein;

means for irradiating said heating chamber with high-frequency energy;

a door for opening and closing the entrance opening of said heating chamber;

a first sealing cavity formed along at least one of a peripheral edge portion of said entrance opening and a portion of said door opposite to said peripheral edge portion of said entrance opening, said first sealing cavity having an opening therein; and a second sealing cavity disposed within the opening of said first sealing cavity, said second sealing cavity having a depth and a width which is less than one-half the corresponding depth and width of said first sealing cavity, respectively.

2. A microwave oven having an electromagnetic energy seal as claimed in claim 1, further comprising a cavity cover covering both said first and second sealing cavities and having a flange-shaped projection extending into said second sealing cavity.

3. A microwave oven having an electromagnetic energy seal, comprising a heating chamber having an entrance opening therein;

means for irradiating said heating chamber with high-frequency energy;

a door for opening and closing the entrance opening of said heating chamber;

a seal comprising a cavity formed along at least one of a peripheral edge portion of said entrance opening and a portion of said door opposite to said peripheral edge portion of said entrance opening;

a metal partition member partitioning said cavity into a first sealing cavity, having an opening therein, and a third sealing cavity, said metal partition member having slits therein at regular spatial intervals; and a second sealing cavity disposed within the opening of said first sealing cavity, said second sealing cavity having a depth and a width which is less than one-half the corresponding depth and width of said first sealing cavity, respectively.

4. A microwave oven having an electromagnetic energy seal as claimed in claim 3, further comprising a cavity cover covering all of said first, second and third sealing cavities and having a flange-shaped projection extending into said second sealing cavity.

5. A microwave oven having an electromagnetic energy seal, comprising a heating chamber having an entrance opening therein;

means for irradiating said heating chamber with high-frequency energy; and a door for opening and closing the entrance opening of said heating chamber, said door comprising a first sealing cavity having an opening opposite to a peripheral edge portion of said entrance opening and a second sealing cavity projecting into the opening of said first sealing cavity, said second sealing cavity having a depth and a width which is less than one-half the corresponding depth and width of said first sealing cavity, respectively.

6. A microwave oven having an electromagnetic energy seal as claimed in claim 5, further comprising a cavity cover covering both said first and second sealing cavities and having a flange-shaped projection extending into said second sealing cavity.

* * * * *